US007175112B2

(12) United States Patent
Uhlmann

(10) Patent No.: US 7,175,112 B2
(45) Date of Patent: Feb. 13, 2007

(54) FUEL INJECTION VALVE

(75) Inventor: Dietmar Uhlmann, Korb (DE)

(73) Assignee: Robert Bosch GmbH (DE)

( * ) Notice: Subject to any disclaimer, the term of this patent is extended or adjusted under 35 U.S.C. 154(b) by 0 days.

(21) Appl. No.: 10/509,057

(22) PCT Filed: Mar. 3, 2003

(86) PCT No.: PCT/DE03/00694

§ 371 (c)(1),
(2), (4) Date: May 13, 2005

(87) PCT Pub. No.: WO03/081023

PCT Pub. Date: Oct. 2, 2003

(65) Prior Publication Data

US 2005/0224604 A1 Oct. 13, 2005

(30) Foreign Application Priority Data

Mar. 26, 2002 (DE) ..... 102 13 382

(51) Int. Cl.
*F02M 61/20* (2006.01)

(52) U.S. Cl. ..... 239/533.9; 239/533.3; 239/533.12; 267/152

(58) Field of Classification Search ..... 239/553.1–533.12, 585.1; 267/147–149, 267/151–153, 162
See application file for complete search history.

(56) References Cited

U.S. PATENT DOCUMENTS 1,557,958 A * 10/1925 Anderson ..... 464/78
2,171,185 A * 8/1939 Friedrich ..... 267/217
3,672,493 A * 6/1972 Modrey ..... 206/525
4,858,897 A * 8/1989 Irifune ..... 267/181
4,919,403 A * 4/1990 Bartholomew ..... 267/165
5,062,619 A * 11/1991 Sato ..... 267/154
5,160,121 A * 11/1992 Bartholomew ..... 267/136
5,558,393 A * 9/1996 Hawkins et al. ..... 267/162
5,967,413 A * 10/1999 Tian ..... 239/88
6,062,497 A * 5/2000 Bryan ..... 239/533.11
6,079,641 A * 6/2000 Shinogle et al. ..... 239/533.4
6,113,012 A * 9/2000 Wear et al. ..... 239/533.9
6,113,082 A * 9/2000 Fujino ..... 267/103
6,142,443 A * 11/2000 Potschin et al. ..... 251/57
6,155,499 A * 12/2000 Rembold et al. ..... 239/533.12
6,279,841 B1 * 8/2001 McCormick ..... 239/585.1

FOREIGN PATENT DOCUMENTS

DE 4016787 * 11/1991
FR 1192901 * 4/1959
FR 2168712 * 8/1973
WO WO 00/08333 * 2/2000

* cited by examiner

*Primary Examiner*—Steven J. Ganey
(74) *Attorney, Agent, or Firm*—Ronald E. Greigg

(57) ABSTRACT

A fuel injection valve for internal combustion engines, with a housing that contains a moving valve element whose movement counter to the elastic force of a spring element controls the fuel supply to the combustion chamber of the engine. The spring element has the form of a cylindrical sleeve whose wall contains openings at a number of locations that allow the spring element to be elastically deformed in the longitudinal direction.

4 Claims, 3 Drawing Sheets

PRIOR ART

FUEL INJECTION VALVE

CROSS-REFERENCE TO RELATED APPLICATIONS

This application is a 35USC 371 application of PCT/DE 03/00694 filed on Mar. 3, 2003.

BACKGROUND OF THE INVENTION

1 . Field of the Invention

The invention is directed to an improved fuel injection valve for an internal combustion engine.

2. Description of the Prior Art

Fuel injection valves of the type with which this invention is concerned are known for example, from the patent application DE 100 24 703A1. Fuel injection valves of this kind have a housing that contains a moving valve element whose movement counter to the elastic force of a spring element controls the fuel supply to the combustion chamber of the engine. The valve element is frequently in the form of a valve needle that has a longitudinal axis and moves in the direction of this longitudinal axis. The spring element is embodied as a helical compression spring disposed coaxial to the valve element in the housing. The known helical compression spring, however, has the disadvantage that in order to be able to provide the necessary rigidity, it must be wound using relatively thick wire and therefore takes up a relatively large amount of space. This constitutes a limitation to further narrowing of fuel injection valves that cannot be surpassed because of the high fuel pressure prevailing there.

SUMMARY AN ADVANTAGES OF INVENTION

The fuel injection valve according to the invention has the advantage over the prior art that the spring element used here, which is embodied in the form of a cylindrical sleeve, provides the same rigidity while requiring less space than a corresponding helical compression spring, thus allowing the outer diameter of the fuel injection valve to be correspondingly reduced. The cylindrical sleeve of the spring element has openings at a number of locations in its wall, which allow the cylindrical sleeve to be elastically deformed in the longitudinal direction.

Advantageous embodiments of the subject of the invention are possible. A favorable longitudinal elasticity of the cylindrical sleeve can be easily achieved though the layout of the openings, which essentially extend in a radial plane of the cylindrical sleeve. It is particularly advantageous here if two similar openings are disposed in a radial plane and are divided from each other by connecting pieces. The elasticity of the cylindrical sleeve can be adjusted very easily by means of the thickness of these connecting pieces. When two openings are provided in a radial plane, it is particularly advantageous of the openings of the immediately adjacent radial planes are rotated by 90° in relation to one another.

In another advantageous embodiment, the openings are embodied in the form of slots. In order to keep the notching stresses at the ends of the slot-shaped openings to a minimum, it is particularly advantageous for the ends to be embodied as rounded. In this embodiment, it has turned out to be particularly advantageous for the openings, which have a longitudinal axis due to their slot-shaped form, to be tapered in the middle in relation to this longitudinal axis. This lends the cylindrical sleeve the desired longitudinal elasticity without the notching stresses at the ends of the openings becoming so great that a plastic deformation of the material of the cylindrical sleeve can occur.

BRIEF DESCRIPTION OF THE DRAWINGS

Other features and embodiments will become apparent from the description contained herein below, taken in conjunction with the drawings, in which.

DESCRIPTION OF THE PREFERRED EMBODIMENTS

Figure 1:
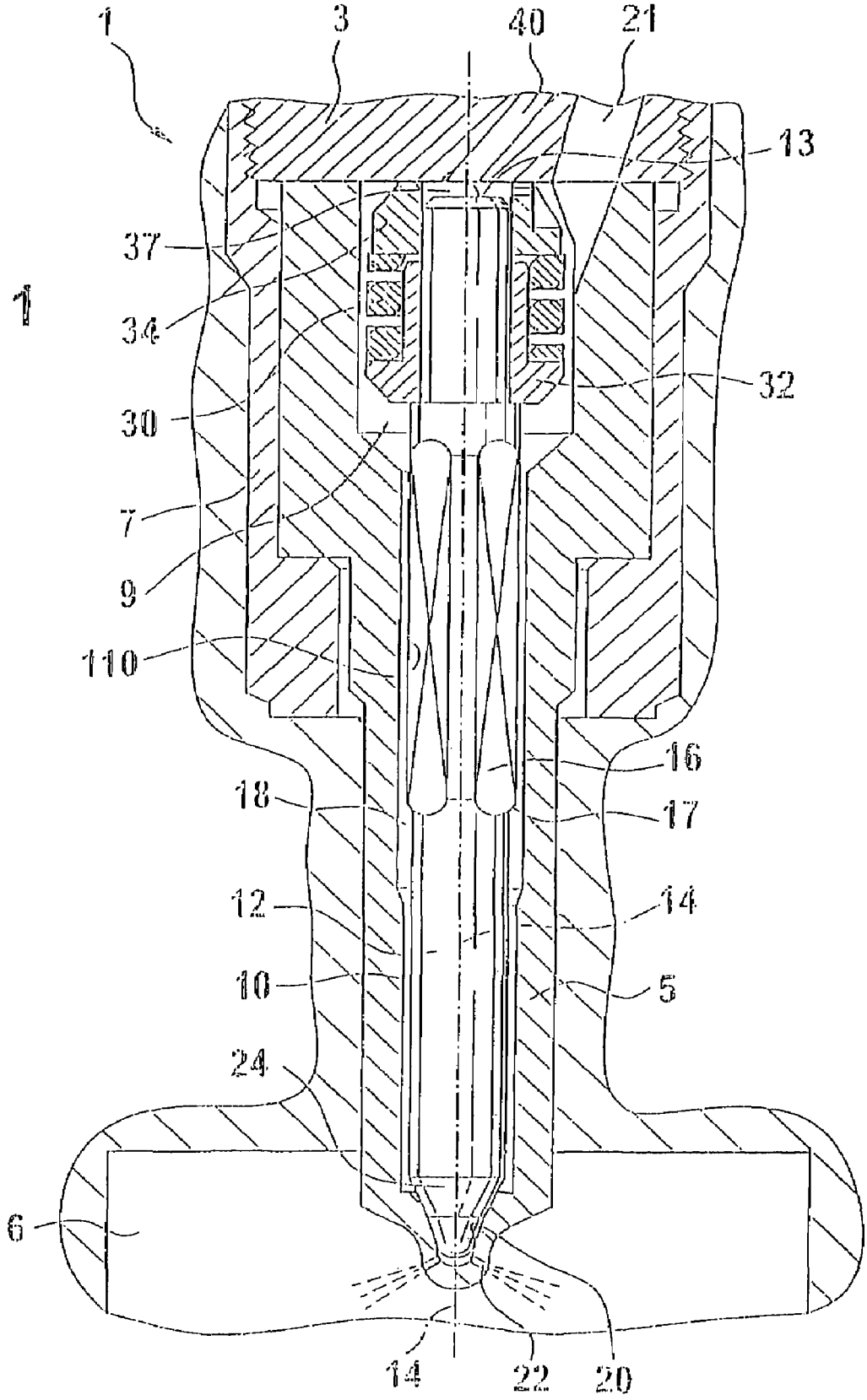
FIG. 1 shows a longitudinal section through a prior art fuel injection valve.

FIG. 1 shows a longitudinal section through a prior art fuel injection valve in which the valve has a housing 1 that has a valve-holding body 3 and a valve body 5 that are clamped against each other in the axial direction by a retaining nut 7. The valve body 5 contains a bore 10 that has a longitudinal axis 14; a piston-shaped valve element 12 is contained so that it can slide longitudinally in the bore 10. At its end oriented away from the combustion chamber, the bore 10 widens out to form an inner chamber 9 that is connected to a supply conduit 21 embodied in the valve-holding body 3. The valve element 12 is guided in a middle bore section 110 of the bore 10 and a pressure chamber 18 in the form of an annular conduit is formed between the valve element 12 and the wall of the bore 10 and can be filled with highly pressurized fuel via the supply conduit 21 and the inner chamber 9. The guided section of the valve element 12 is provided with four ground surfaces 16 that make it possible for the fuel to flow from the inner chamber 9, between the valve element 12 and the wall of the bore 10, and into the pressure chamber 18. At the end of the bore 10 protruding into the combustion chamber 6 of the engine, a valve seat 20 is provided, which is conically shaped and cooperates with a valve-sealing surface 24 embodied at the combustion chamber end of the valve element 12 in such a way that when the valve-sealing surface 24 is lifted away from the valve seat 20, fuel can flow out of the pressure chamber 18, between the valve-sealing surface 24 and the valve seat 20, to injection openings 22 provided in the valve body 5, through which the fuel is injected into the combustion chamber 6 of the engine. If the valve-sealing surface 24 is resting against the valve seat 20, then the injection openings 22 are closed so that this fuel flow is interrupted.

The inner chamber 9 contains a sleeve 34, a spring element 30, and a spring plate 32, which encompass the end section of the valve element 12 oriented away from the combustion chamber. The end surface 13 of the valve element 12 oriented away from the combustion chamber, the valve-holding body 3, and the sleeve 34 encompassing the valve element 12 delimit a control chamber 37 into which highly pressurized fuel can be conveyed via a central control bore 40 embodied in the valve-holding body 3. The spring element 30 is disposed between the sleeve 34 and the spring plate 32 under a compressive initial stress that pushes the sleeve 34 and the spring plate 32 apart from each other.

Since the spring plate 32 is supported on the valve element, this presses the valve element 12 against the valve seat 20.

The longitudinal movement of the valve element 12 is controlled by means of the hydraulic pressure in the pressure chamber 18 and the pressure in the control chamber 37. During operation of the internal combustion engine, a continuous high fuel pressure prevails in the pressure chamber 18, which generates a hydraulic force on a pressure shoulder 17 that is formed at the transition from the section of the valve element 12 oriented toward the combustion chamber into the guided section in the region of the ground surfaces 16. This exerts an opening force on the valve element 12 that is directed away from the valve seat 20. This opening force works in opposition to the force of the prestressed spring element 30 and the hydraulic closing force that the pressure in the control chamber 37 exerts on the end 13 of the valve element 12. If a high fuel pressure prevails in the control chamber 37, then the valve element 12 is held in its closed position since the hydraulically effective area of the pressure shoulder 17 is significantly smaller than that of the end surface 13 of the valve element 12. If the pressure in the control chamber 37 is relieved via the control bore 40, then the hydraulic force on the pressure shoulder 17 moves the valve element 12 away from the valve seat 20 counter to the force of the spring element 30 that fuel is injected through the injection openings 22 into the combustion chamber 6 of the engine in the above-described manner. Since pressures of more than 100 MPa can prevail in the pressure chamber 18 and the control chamber 37, the force of the spring element 30 only plays a secondary role in the opening stroke motion of the valve element 12. The spring element 30 mainly serves to keep the valve element 12 in the closed position when the internal combustion engine is not running and there is no fuel pressure in the pressure chamber 18 and in the control chamber 37.

Figure 2:
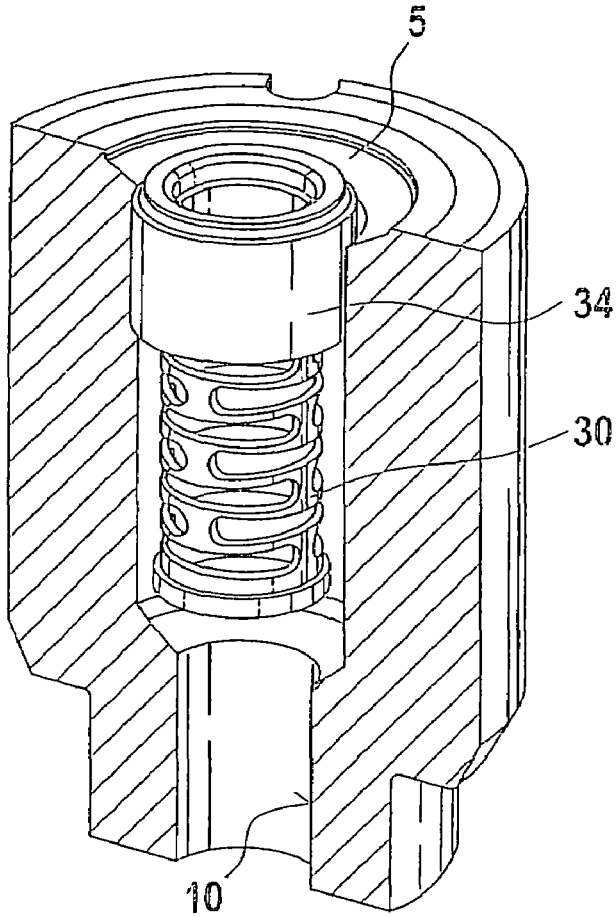
FIG. 2 is a perspective sectional view of a valve body according to the invention; the valve element has been omitted for the sake of visibility.
Figure 3:
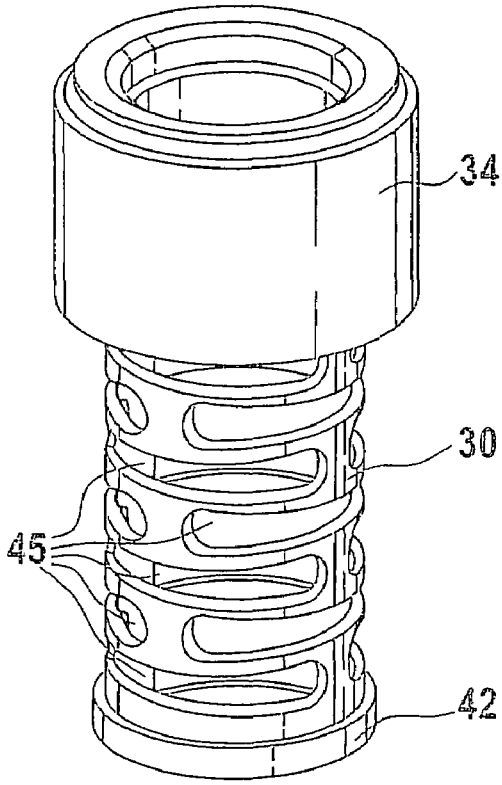
FIG. 3 is an enlarged depiction of the spring element of FIG. 2 with a sleeve attached to it.
Figure 4:
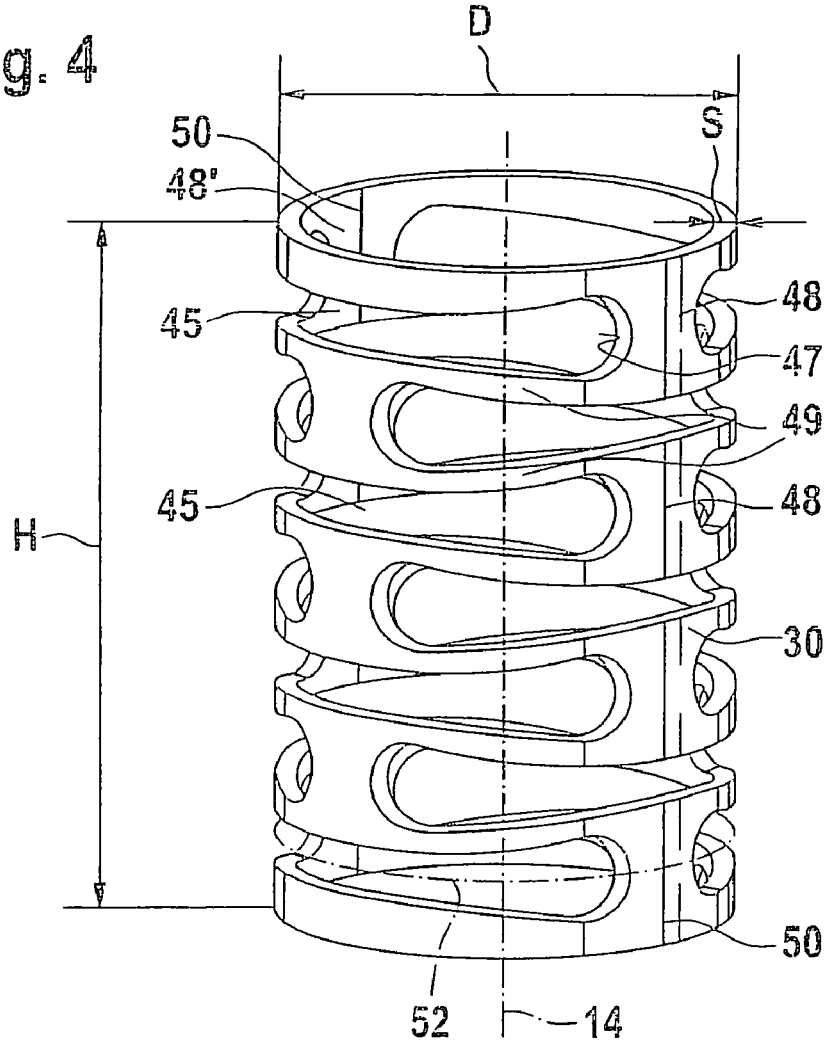
FIG. 4 shows the spring element in the unloaded state.

FIG. 2 is a perspective, sectional view of the valve body 5 embodying a spring element 30 according to the invention. The valve element 12 here has been omitted for the sake of visibility. The sleeve 34 is embodied of one piece with the spring element 30, thus eliminating the contact surface between these two parts. FIG. 3 shows an enlarged depiction of the spring element 30, together with the sleeve 34 and a ring element 42 that adjoins the elastic element 30 at the end oriented away from the sleeve 34 and supports the spring element 30 directly against the valve element 12. The ring element 42 here can likewise be of one piece with the spring element 30 or can be embodied as a separate component that is attached to the spring element 30, e.g. by means of welding or soldering. The spring element 30 is embodied as a cylindrical sleeve that has a number of openings 45 in its wall, which allow the spring element 30 to be elastically deformed in the longitudinal direction. The precise design of the spring element 30 embodied as a cylindrical sleeve is shown in FIG. 4; the spring element 30 here is shown in the unloaded state and in this instance, is produced as a separate component without the sleeve 34 and the ring element 42. The openings 45 of the spring element 30 are embodied in the form of slots and have a longitudinal axis 52 that extends in a radial plane in relation to the longitudinal axis 14 of the spring element 30. The ends 47 of the slot-shaped openings 45 are rounded in order to reduce the notching stresses that occur in them when the spring element 30 is compressed. A plastic deformation of the material at the ends 47 of the openings 45 must be definitely prevented in order to maintain the rigidity of the spring element 30 over its entire service life. Otherwise, the spring element 30 would be irreversibly deformed, which would alter its rigidity.

Two slot-shaped openings 45 are respectively disposed in a radial plane of the spring element 30 and are separated from each other by a connecting piece 48 and by a connecting piece 48'disposed opposite from it. The openings 45 disposed in the adjacent radial plane are embodied the same, but are rotated by 90° in relation to the longitudinal axis 14. This produces cantilevers 49 between the connecting pieces 48 of two adjacent radial planes; the bending of these cantilevers when the spring element 30 is loaded constitutes the elastic deformability of the spring element 30. The elasticity and therefore the spring constant of the spring element 30 can be set by means of the thickness of the cantilevers 49 and via their length, which is a result of the thickness of the connecting pieces 48. Preferred measurement of the spring element 30 are an outer diameter D of 4.0 mm to 4.5 mm and a wall thickness S of 0.4 mm to 0.5 mm. The width of the connecting piece 48 is approximately 0.8 mm and the rounding radius at the ends 47 of the openings 45 is approximately 0.4 mm to 0.5 mm. The overall height H of the spring element 30 is approximately 10 mm. These dimensions yield a spring constant of the spring element 30 of approximately 30 N/mm. The outer diameter of the spring element 30 required for this is significantly smaller than that of a helical compression spring with a comparable spring constant.

Figure 5:
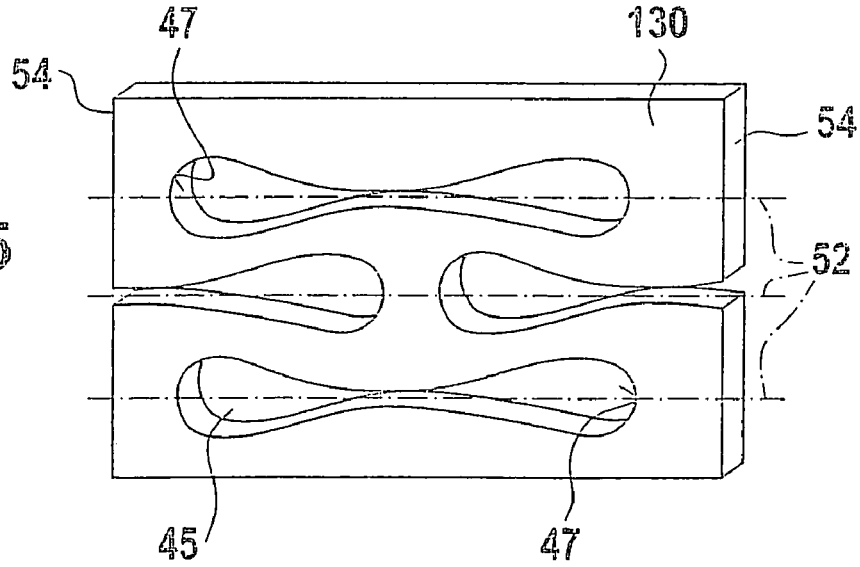
FIG. 5 shows a sheet-like starting material from which the spring element can be made.

The spring element 30 shown here is comprised of two half-cylinders that are attached to each other at welding seams 50. For example, the spring element 30 is manufactured such that two half-cylinders are produced separately and are then attached to each other at welded seams 50. FIG. 5 shows an intermediate step of one of the half-cylinders, namely a spring element half 130, which is a rectangular, planar sheet made of a suitable steel. Openings are produced in the spring element half 130, for example by means of punching. The spring element half 130 is then curved so that the side surface 54 can be attached to a corresponding side surface 54 of a second spring element half 130, preferably by means of welding.

If the spring element 30 is made of one piece, for example by means of deep drawing, then this eliminates the welded seams 50. In this instance, the openings 45 can be produced not only by means of punching, but also with the aid of a laser, for example. The choice as to the most suitable manufacturing process depends on the mechanical stress to be expected in the spring element 30.

In addition to suing the spring element 30 to act on a valve element 12, the spring element 30 according to the invention can also be used in other locations in a fuel injection valve where space is limited and the spring element must take up the smallest amount of space possible. Other possible exemplary embodiments include solenoid valves in fuel injection valves.

The foregoing relates to preferred exemplary embodiments of the invention,it being understood that other variants and embodiments thereof are possible within the spirit and scope of the invention, the latter being defined by the appended claims.

The invention claimed is:

1. In a fuel injection valve for internal combustion engines, with a housing (1) that contains a moving valve element (12) whose movement counter to the elastic force of a spring element (30) controls the fuel supply to the combustion chamber (6) of the engine, the improvement wherein the spring element (30) comprises a cylindrical sleeve having a longitudinal axis (14), openings (45) at a number of locations in the wall of the sleeve, the openings (45) being separate from one another to allow the spring element (30)

to be elastically deformed in the direction of the longitudinal axis (14), the openings comprise two continuous slot-shaped openings (45) disposed in a radial plane of the spring element (30), the two openings are separated from each other by a single first connecting piece (48) and a single second connecting piece (48') disposed opposite from the first connecting piece (48), and wherein the openings (45) have a longitudinal axis (52) in relation to which they are symmetrical and wherein the openings (45) have the form of a longitudinal slot that tapers in the middle in relation to this longitudinal axis (52).

2. The fuel injection valve according to claim 1, wherein the openings (45) are disposed in at least two radial planes, and wherein the openings of the one radial plane are rotated by 90° in relation to those in the adjacent radial plane.

3. The fuel injection valve according to claim 1, wherein the ends (47) of the openings (45) are rounded.

4. The fuel injection valve according to claim 1, wherein the spring element (30) is contained in the housing (1) in an elastically prestressed position.

* * * * *